US007997772B2

(12) United States Patent
Avtzon et al.

(10) Patent No.: US 7,997,772 B2
(45) Date of Patent: Aug. 16, 2011

(54) FLAMELESS CANDLE WITH MULTIMEDIA CAPABILITIES

(75) Inventors: Moshe Avtzon, Brooklyn, NY (US); Michael Friend, Rockville Centre, NY (US)

(73) Assignee: Fasst Products, LLC, Rockville Centre, NY (US)

( * ) Notice: Subject to any disclaimer, the term of this patent is extended or adjusted under 35 U.S.C. 154(b) by 0 days.

(21) Appl. No.: 12/146,766

(22) Filed: Jun. 26, 2008

(65) Prior Publication Data

US 2009/0040756 A1 Feb. 12, 2009

Related U.S. Application Data

(60) Provisional application No. 60/954,885, filed on Aug. 9, 2007.

(51) Int. Cl.
*F21V 21/00* (2006.01)

(52) U.S. Cl. ..... 362/392; 362/161; 362/447

(58) Field of Classification Search ..... 362/269, 362/161, 392, 447, 810, 86, 276, 802
See application file for complete search history.

(56) References Cited

U.S. PATENT DOCUMENTS

| | | | | |
|---|---|---|---|---|
| 3,967,545 | A | 7/1976 | Baker | |
| 4,301,783 | A | 11/1981 | Buckner et al. | |
| 4,510,556 | A * | 4/1985 | Johnson | 362/184 |
| 4,816,973 | A | 3/1989 | Atalla et al. | |
| 5,075,005 | A | 12/1991 | Brindopke | |
| 5,174,645 | A | 12/1992 | Chung | |
| 5,810,895 | A | 9/1998 | Staehle et al. | |
| 6,033,209 | A | 3/2000 | Shin et al. | |
| 6,074,199 | A | 6/2000 | Song | |
| 6,413,476 | B1 | 7/2002 | Barnhart | |
| 6,454,425 | B1 | 9/2002 | Lin | |
| 6,468,071 | B2 | 10/2002 | Zou | |
| 6,520,770 | B2 | 2/2003 | Zou | |
| 6,966,665 | B2 | 11/2005 | Limburg et al. | |
| 7,029,146 | B2 | 4/2006 | Kitchen | |
| 7,132,084 | B1 | 11/2006 | Roumpos | |
| 7,699,603 | B2 * | 4/2010 | Furner et al. | 431/292 |
| 2002/0080601 | A1 | 6/2002 | Meltzer | |
| 2002/0093834 | A1 * | 7/2002 | Yu et al. | 362/565 |
| 2003/0007887 | A1 | 1/2003 | Roumpos et al. | |
| 2004/0160764 | A1 * | 8/2004 | Lee | 362/161 |

(Continued)

FOREIGN PATENT DOCUMENTS

EP 0882459 12/1998

(Continued)

OTHER PUBLICATIONS

Candle Breeze™, CandleBreeze® Makes Great Scents, Catalog Product Sheet, available at http://www.thecandlewarmer.com/index.cfm?fuseaction=Catalog.Candle%20Breeze™, Mar. 15, 2007.

(Continued)

*Primary Examiner* — Julie A Shallenberger
(74) *Attorney, Agent, or Firm* — Gordon & Jacobson, PC

(57) ABSTRACT

A flameless candle having speaker and lighting capability is provided. Multiple of such flameless candles can be used in a system to generate stereo or surround sound, as well as various lighting modes. The flameless candle or flameless candle system can have AM/FM radio functions, clock functions, alarm functions, etc., and can be used as an audio monitor. In addition, the flameless candle or candle system may be equipped with video capability.

25 Claims, 16 Drawing Sheets

U.S. PATENT DOCUMENTS

| | | | | |
|---|---|---|---|---|
| 2004/0257798 | A1 | 12/2004 | Hart et al. | |
| 2005/0180148 | A1 * | 8/2005 | Ham et al. | 362/447 |
| 2007/0236947 | A1 * | 10/2007 | Jensen et al. | 362/392 |
| 2007/0291488 | A1 * | 12/2007 | Heathcock | 362/276 |

FOREIGN PATENT DOCUMENTS

| | | |
|---|---|---|
| EP | 1283062 | 2/2003 |
| GB | 2285579 | 7/1995 |
| WO | WO 95/10352 | 4/1995 |
| WO | WO01/02025 | 1/2001 |
| WO | WO01/23008 | 4/2001 |
| WO | WO02/30220 | 4/2002 |
| WO | WO02/31413 | 4/2002 |
| WO | WO03/086487 | 10/2003 |
| WO | WO2005/003623 | 1/2005 |

OTHER PUBLICATIONS http://www.thecandlewarmer.com/index.cfm?fuseaction=Catalog.ViewProduct&productid=6, Mar. 15, 2007.

Fragrance Without a Flame™, CandleBreeze® Makes Great Scents, product description sheet, available at www.thecandlewarmer.com/ , Mar. 15, 2007.

www.thecandlewarmer.com/index.cfm?fuseaction=Home.ViewPage&page_id=5451A4F0-D9A6-4A09-A6BBB7B2A76F8304, Mar. 15, 2007.

home.ViewPage&page_id=8C38D2E4-2078-03EB-5199796C71BB4E09, downloaded Mar. 15, 2007.

DA92-443B-B261B43BDC98E07D, downloaded Mar. 15, 2007.

* cited by examiner

FLAMELESS CANDLE WITH MULTIMEDIA CAPABILITIES

This application claims priority from provisional application 60/954,885 filed Aug. 9, 2007, which is hereby incorporated by reference herein in its entirety.

BACKGROUND

1. Field of the Invention

This application is directed to a flameless candle with multimedia capabilities. More particularly, this invention is directed to a flameless candle with a speaker which may be used either alone or with one or more other similar units adapted for audio or audio/visual capabilities.

2. State of the Art

Flameless candles are known where electric or electronic devices provide a flame-like light. Such candles are particularly useful for situations or placements where a typical candle with a real flame would be inappropriate for health or safety reasons. Configurations of flameless candles are known where the candles are light-, sound-, or motion-sensitive. See, for example, U.S. Pat. Nos. 5,174,645 and 6,033,209.

Also, candle devices are known where prerecorded music on an integrated chip or cassette is provided. See, for example, U.S. Pat. Nos. 5,075,005, 6,074,199, 6,468,071, and 6,520,770.

SUMMARY OF THE INVENTION

The present invention provides a modified flameless candle having multimedia capabilities.

The present invention also provides two or more flameless candle units, each having a speaker that can provide stereo or surround-sound music.

The present invention further provides a flameless candle having a candle body, a non-flammable source of light positioned within the candle body, and a sound-generating means.

The invention also provides a flameless candle system, which includes a first candle having a candle body, a non-flammable source of light positioned within the candle body, and a sound-generating means, and a second candle having a candle body, a non-flammable source of light positioned within the candle body, and a sound-generating means.

According to the invention, a flameless candle is provided with "speaker" capability. The light for the flameless candle can comprise known technology, such as a bulb or LED or other typical light source, connected to a battery. The "speaker" capability of the flameless candle means that it has the ability to generate sound, such as music or voice.

The candle body is provided with a top surface defining a recess through which a decorative wick is positioned, a bottom surface preferably including at least one aperture or hole, and a curved (cylindrical) side surface.

The music or voice capability of the flameless candle of the invention can be provided by various mechanisms. In a preferred embodiment of the invention, the flameless candle has a small speaker that is positioned within the candle body to generate sound, and the candle body has one or more apertures (openings) such as on its bottom surface to better permit the sound to be heard. Other sound-generating technologies such as piezoelectric film, either within the candle body or on the outer surface thereof could be used as well.

The light of the flameless candle is typically powered by one or more small batteries. The sound generating device within the flameless candle could be connected to that same battery source or could have a separate source of power. In a preferred embodiment of the invention, the sound generating system has a power source separate from the power source for the light, from one or a number of batteries or from electrical current through a transformer.

In one embodiment of the invention, the flameless candle has a light intensity adjusting means which controls the intensity of light emitted from the non-flammable source ranging from a minimum light intensity to a maximum light intensity. In another embodiment, the light intensity adjusting means is a knob. In another embodiment, a photo sensor attached to the source of light may control the illumination intensity (level of light emitted) of the source of light in response to external light conditions. For example, the photo sensor may send a signal to the source of light to adjust to a maximum light intensity in dark conditions.

In another embodiment of the invention, a sound generating system comprises one or more flameless candle units with speaker capability that are electrically connected. For example, two or more such units could comprise a stereo system, or there could be three or more units to provide a surround-sound system. In such a case, typically one unit has a power source that in turn provides electrical power to the one or more other satellite units.

In another embodiment of the invention, one or more of the candle units could have storage space to receive and store excess wire between the two candle units. For example, there could be a spool upon which the excess speaker wire could be wound.

In another embodiment of the invention, one or more of the candle units are wirelessly connected. The first candle unit is an audio source, i.e., it has audio playback means, an AM/FM transmitter, etc. The first candle wirelessly sends an audio signal to at least a second candle which could then play the audio signal. In another embodiment, the first candle with the audio source and at least a second candle which wirelessly receives the signal from the source are adapted to provide a stereo effect. In another embodiment, the first candle with the audio source and a plurality of second candles may be positioned to provide a surround sound effect.

In another embodiment of the invention, a flameless candle contains an input port to receive an input signal from a portable audio device, e.g., a compact disc player, MP3 player, satellite radio receiver, or any device with a headphone jack.

In another embodiment of the invention, a flameless candle has a modular docking unit for connecting to the port of a portable audio device. In such an embodiment the modular docking unit interfaces with a portable audio device to play audio data from the portable audio device through the candle speakers. In a preferred embodiment of the invention, the modular docking unit has a recess for placement of the portable audio device. The flameless candle of the invention further provides a power supply to the battery of the portable audio device when the flameless candle is plugged into an external power source.

In another embodiment of the invention, one or more candle units contain a sound chip positioned within the candle body. In a preferred embodiment, the sound chip contains pre-recorded audio playable through the speakers of the candle.

In another embodiment of the invention, a flameless candle has an audio playback means. In a preferred embodiment, the audio playback means is a compact disc player. In this embodiment, the candle body is adapted with compact disc playback controls which may be positioned on the surface of the candle body.

In another embodiment of the invention, a flameless candle contains an AM/FM receiver and power circuitry to accommodate AM/FM reception of audio content by the AM/FM receiver.

In another embodiment of the invention, a flameless candle has video capability. In this embodiment, a video display is positioned on the candle body or in a candle body recess to display images from a video generating means. Such video generating means may include DVD, cable signal, antenna transmission, or any known technique.

In another embodiment of the invention, a flameless candle has a clock with functionalities such as a timer and/or an alarm. In this embodiment, a display is positioned on the outer surface or a recess of the outer surface on the candle to display. Alarm and clock controls may be positioned on the surface of the candle.

In another embodiment of the invention, a flameless candle has a motion detection sensor positioned in a recess on the side surface of the flameless candle. The motion detection sensor is attached to the source of light and may activate the source of light in response to external motion in the environment.

In another embodiment of the invention, an audio monitoring system comprises one or more flameless candle units wirelessly connected. In such an embodiment, the transmitter unit includes a microphone, a transmitter connected to the microphone for broadcasting on a radio frequency signal ambient sounds picked up by the microphone near the monitoring unit. The transmitter unit further contains a sound generating means. The receiver unit includes a receiver tuned to the radio frequency signal from the transmitter and means within the receiver for detecting and converting ambient sounds in the radio frequency into an audio output signal. The receiver unit further contains a sound generating means. Such an embodiment may be used to monitor an individual in need of care, e.g., an infant or elderly person, in a proximal or distant location. The invention may be further used for security purposes.

In another embodiment of the invention, a video monitoring system comprises two or more flameless candle units wirelessly connected. In such an embodiment, a flameless candle transmitter unit contains a camera positioned on the candle body. Video compression circuitry is coupled to the camera for receiving video signals from the camera. A radio transmitter is then coupled to the video compression circuitry for transmission of the compressed video signals from the camera to the receiving unit. Control circuitry is coupled to the radio transmitter whereby the radio transmitter transmits the control commands to the receiver unit. The transmitter further includes a microphone and a transmitter connected to the microphone for broadcasting on a radio frequency signal ambient sounds picked up near the monitoring device.

In this embodiment, a second flameless candle comprises a flameless candle unit receiver unit which includes a display positioned on the side surface of the flameless candle coupled to the video decompression circuitry. The display selectively displays images represented by the decompressed video signals. The receiver unit further includes a receiver tuned to the radio frequency from the transmitter and means within the receiver for detecting and converting ambient sounds in the radio frequency into an audio output signal and a sound generating means.

In another embodiment, at least one satellite flameless candle is electronically coupled to a controller which houses a subwoofer, audio amplification circuitry, LED control circuitry, an input control switch, and an input control knob, and which connects to the port of a portable audio device to play audio data from the portable audio device through the candle speakers. The input control knob allows users to turn the flameless candle and subwoofer on and off, as well as to control the volume of sound coming out of the subwoofer and the flameless candle. The input control switch and LED control circuitry allows users to switch the satellite candle(s) to a variety of different lighting modes.

DETAILED DESCRIPTION OF THE INVENTION

The invention can be appreciated from the drawings. It should be noted herein that throughout the various drawings, like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures.

Figure 1:
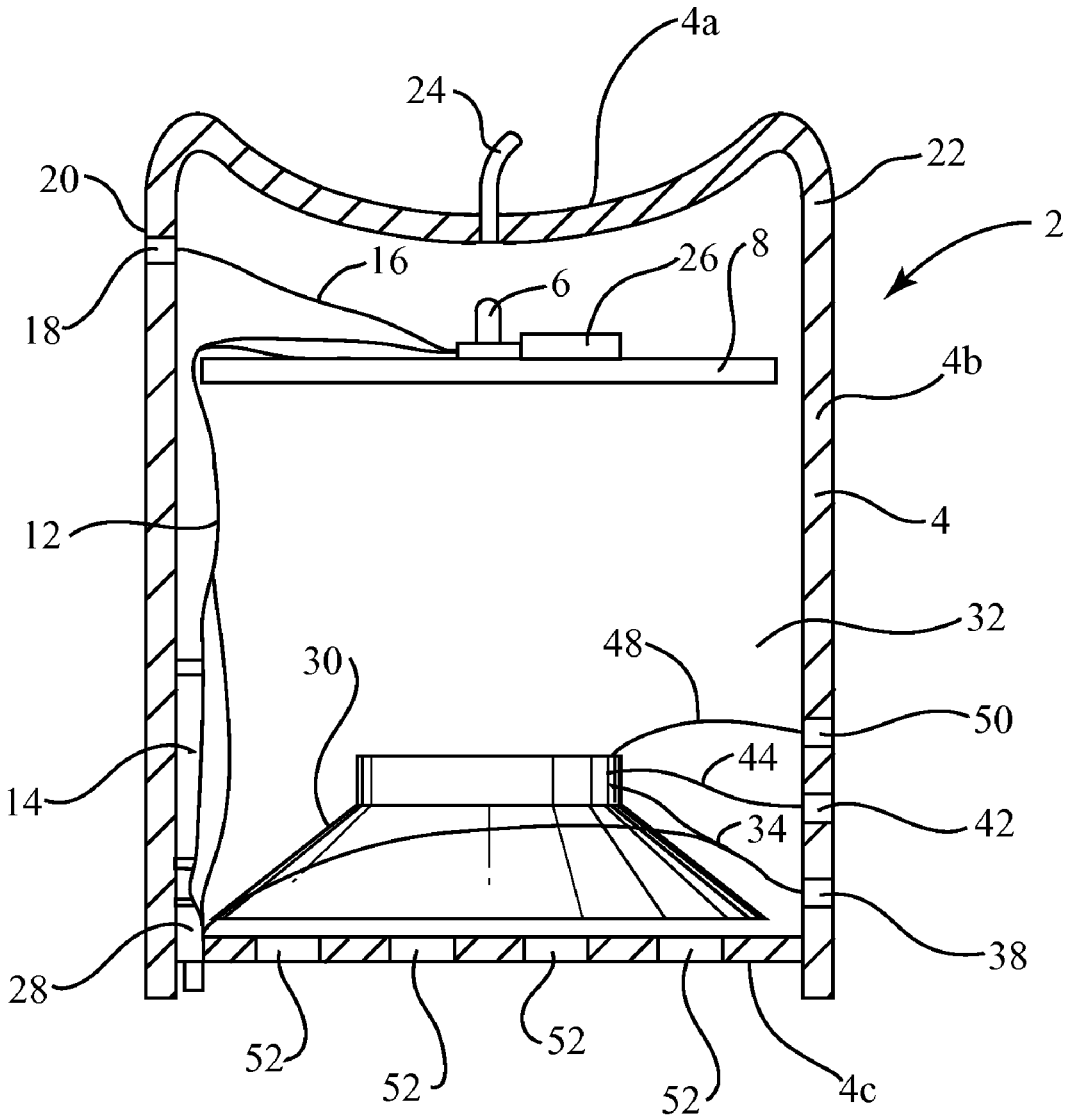
FIG. 1 is a schematic cross-sectional lateral view of an embodiment of the invention.

In the schematic, cross-sectional representation of FIG. 1, a flameless candle 2 comprises a generally cylindrical body 4 having a non-flammable light source such as a bulb or LED 6 that is positioned on a lateral member 8. LED 6 is connected through wires 12 to a battery 14. LED 6 may optionally be connected through wires 16 to a sensor 18. Sensor 18, shown here in position 20, can be in any appropriate location to sense light, motion, or perhaps temperature. Preferably the top portion 22 of body 4 includes a top wall 4*a* which defines a recess or opening through which a butyl rubber wick 24 extends. Body 4 is preferably translucent and may have additionally include openings (not shown) to permit light to be seen when LED 6 is activated. Also, optionally additional circuitry or electronics 26 may be provided to cause the LED to flicker or modulate (i.e., to simulate the light generated by a burning candle). If sensor 18 is a light sensor, circuitry 26 can cause LED 6 to be activated only in relative or total darkness. Preferably there is a switch 28 having two or more positions to activate the light system and/or the speaker. A 4-way switch would have positions for OFF, light ON, speaker ON, and light/speaker ON.

A sound-generating means such as a speaker 30 positioned in a lower chamber 32 of candle body 4, where the lower chamber 32 is typically defined by curved side wall 4*b*, bottom wall 4*c* and lateral member 8. The speaker 30 is connected through wires 34 to a jack or receptacle 38. Jack 38 can receive a plug from a power source (not shown), such as typical AC adapter/transformer that is in turn connected to a wall outlet. Another jack or receptacle 42, connected to speaker 30 through wires 44, receives audio signals from a source of sound, such as a radio, stereo, MP3 player, etc. (not shown). Optionally, speaker 30 is connected through wires 48 to a third jack or receptacle 50 that can receive a plug from another speaker unit, which may be a candle similar to candle 2 or a separate speaker unit of some sort.

Preferably, the bottom wall 4*c* of body 4 has apertures, perforations or slots 52 to facilitate the passage of sound generated by speaker 30. Also, there may be knobs or slides (not shown) for volume or tone control or balance.

Figure 2:
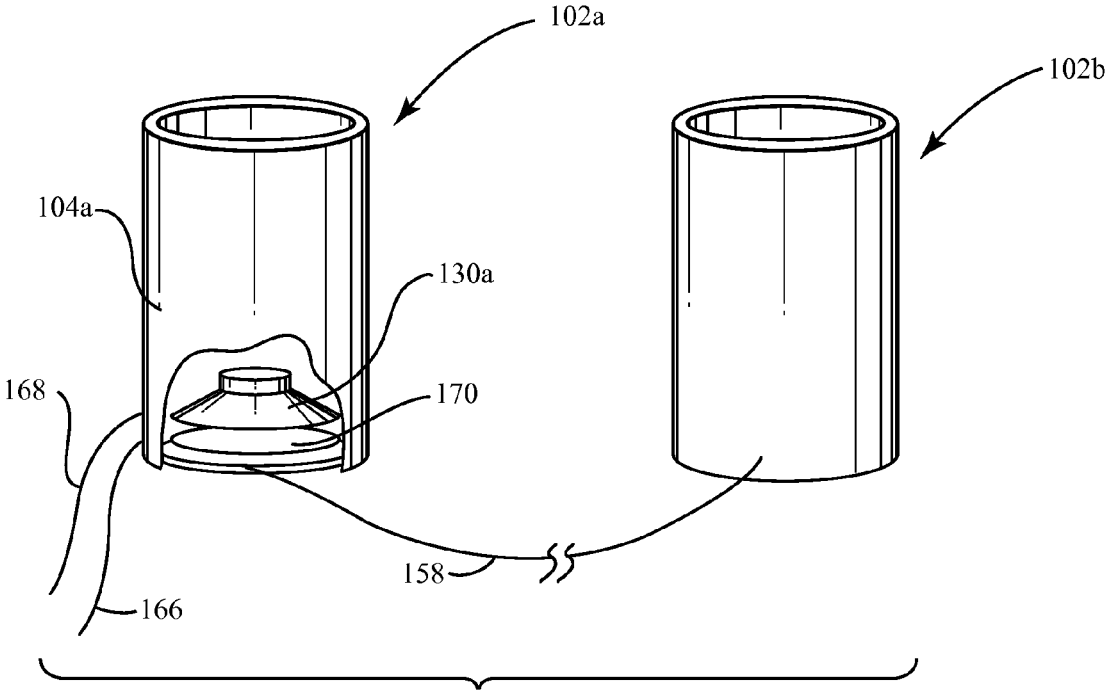
FIG. 2 is a view of another embodiment of the invention where one flameless candle is shown in partial cross-section and another flameless candle is shown in perspective.

In another embodiment of the invention shown in FIG. 2, a first flameless candle 102*a* is connected by speaker wire 158 to a second flameless candle 102*b*. Candle 102*a* has a candle body 104 which receives a wire 166 from a power source (not shown) and a wire 168 from an audio signal source (not shown). Excess speaker wire 158 is wound inside a storage area 170 below a speaker 130*a* in candle body 104*a*.

Figure 3:
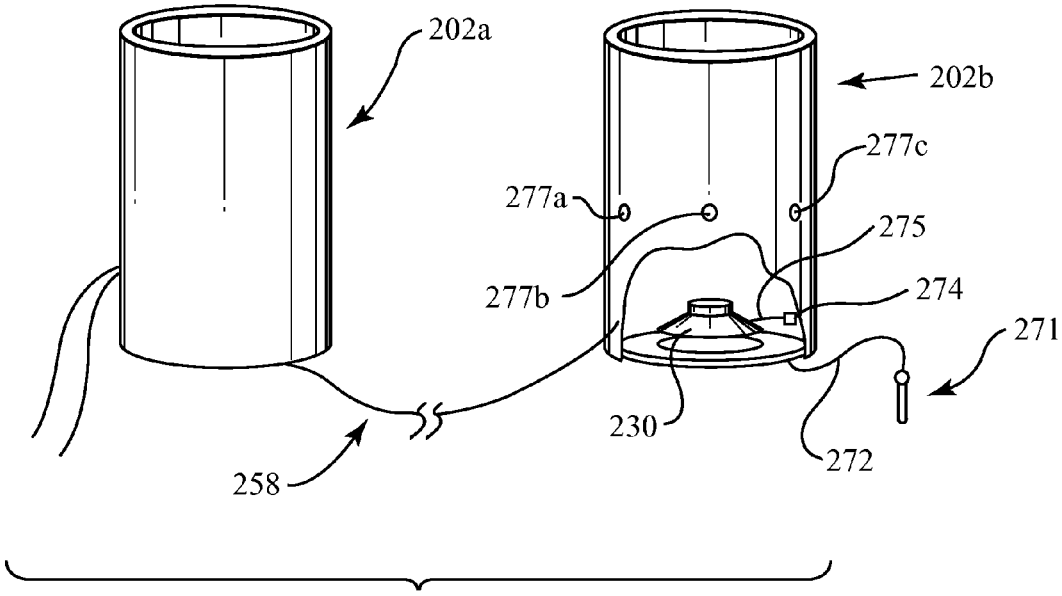
FIG. 3 is a view of an embodiment of the invention where one flameless candle is shown in partial cross-section with an audio jack indicated and another flameless candle is shown in perspective.

In another embodiment of the invention shown in FIG. 3, a first flameless candle 202*a* is connected to a second flameless candle 202*b* by speaker wire 258. Audio input 271 is connected to the second flameless candle 202*b* by a wire 272. Audio input 271 may be connected to the headphone jack of a portable audio device (not shown) to receive audio data to be played through a flameless candle speaker 230. AM/FM receiver 274 is configured to receive radio broadcasts and is coupled to speaker 230 via wire 275. Also, there may be knobs or slides 277*a*, 277*b*, 277*c* coupled to the AM/FM receiver 274 and/or the speaker 230 for AM/FM channel control, volume or tone control, and balance (left-right) control.

Figure 4:
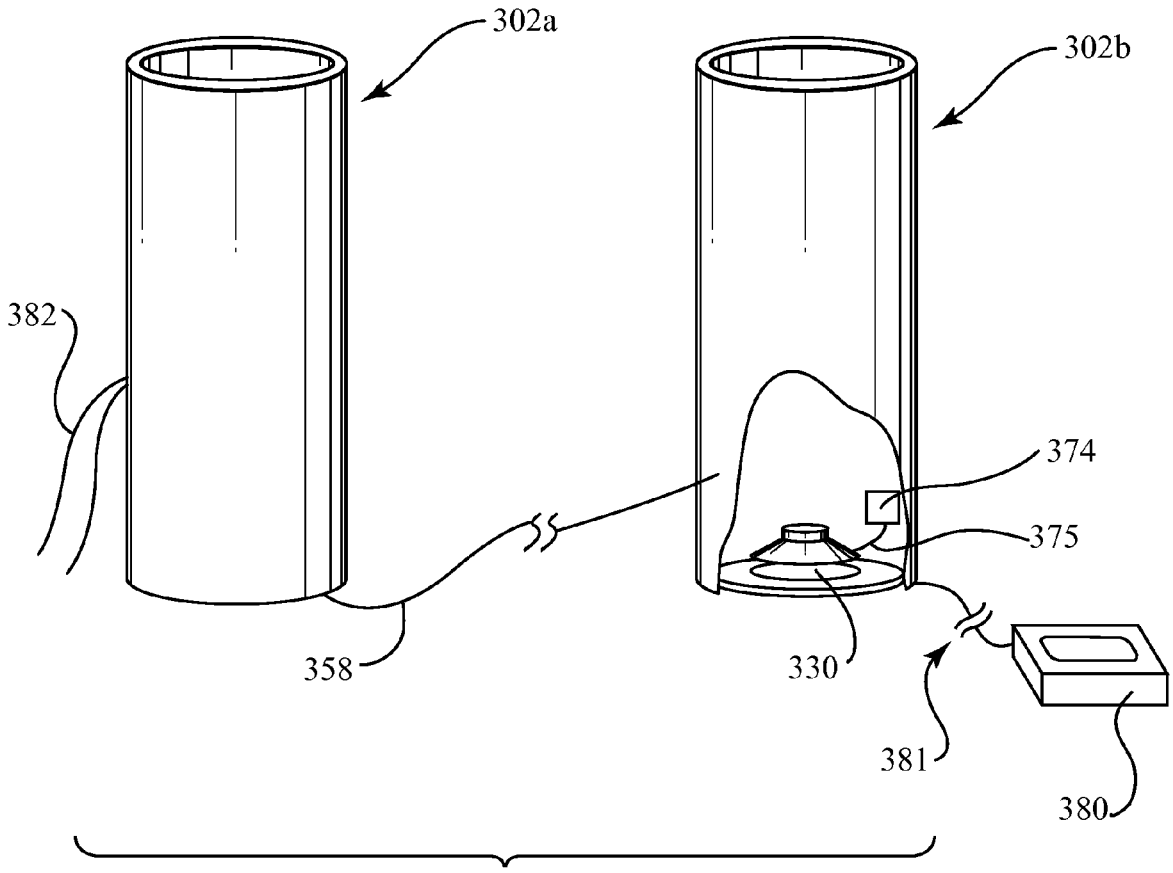
FIG. 4 is a view of an embodiment of the invention where one flameless candle is shown in partial cross-section with a charging dock indicated and another flameless candle is shown in perspective.

In another embodiment of the invention shown in FIG. 4, a first flameless candle 302*a* is connected to a second flameless candle 302*b* by speaker wire 358. Modular docking unit 380 is connected to second flameless candle 302*b* by a wire 381. Modular docking unit 380 may be connected to the audio interface of a portable audio device (not shown). Modular docking unit 380 may be adapted for different audio interfaces. Modular docking unit 380 may receive power to charge a portable audio device when the candle system is plugged into a power source (not shown) through an AC adapter (not shown) connected through wire 382. AM/FM receiver 374 which is configured to receive radio broadcasts is coupled via wire 375 to speaker 330. Also, there may be knobs or slides for AM/FM channel control, volume or tone control, or balance (as shown in FIG. 3).

Figure 5:
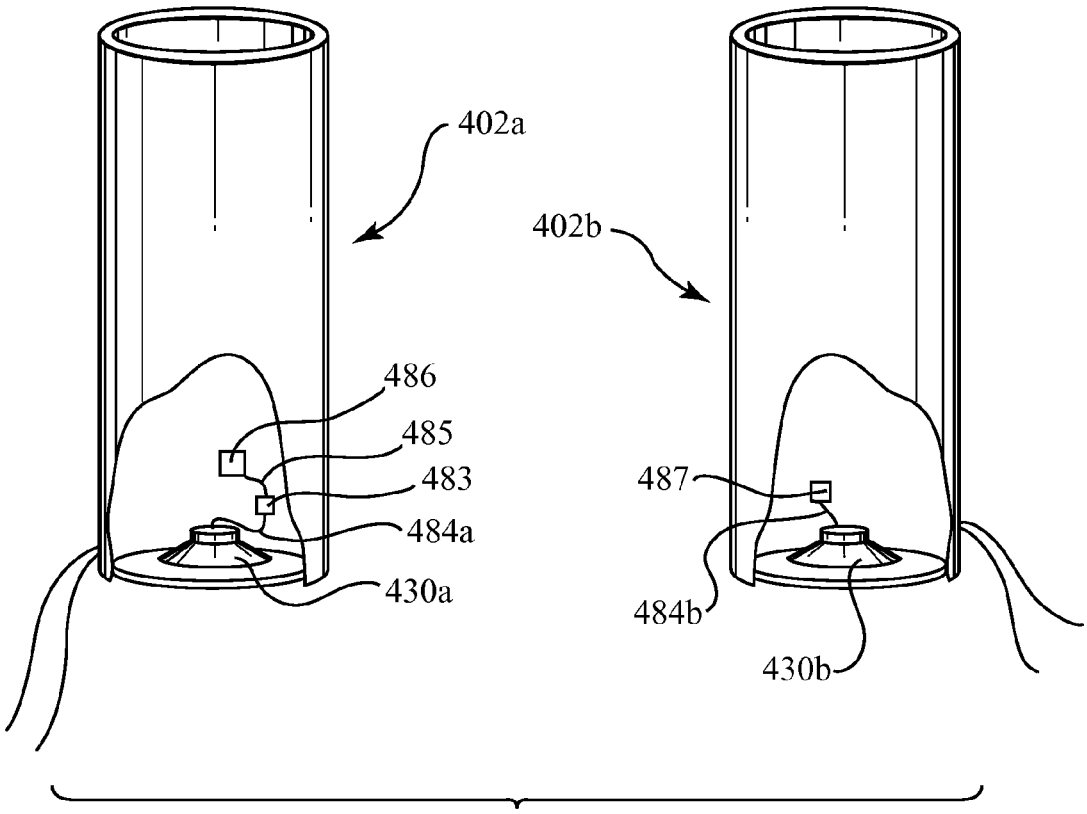
FIG. 5 is a view of an embodiment of the invention where one flameless candle is depicted in partial cross-section containing wireless audio source transmitter and a second flameless candle is depicted in partial cross-section containing a wireless audio source receiver.

In another embodiment of the invention shown in FIG. 5, a first flameless candle 402*a* is connected to a second flameless candle 402*b* wirelessly. An audio source 483 is connected by wire 484*a* to a speaker 430*a* for playback in the first candle. The audio source 483 is also connected by wire 485 to a wireless transmitter 486*a* which transmits the audio signal to one or more candles which may contain a wireless receiver 487. The wireless receiver 487 is connected by wire 484*b* to a speaker 430*b* in a second candle 402*b*. Also, there may be knobs or slides for volume or tone control, or balance (as shown in FIG. 3).

Figure 6:
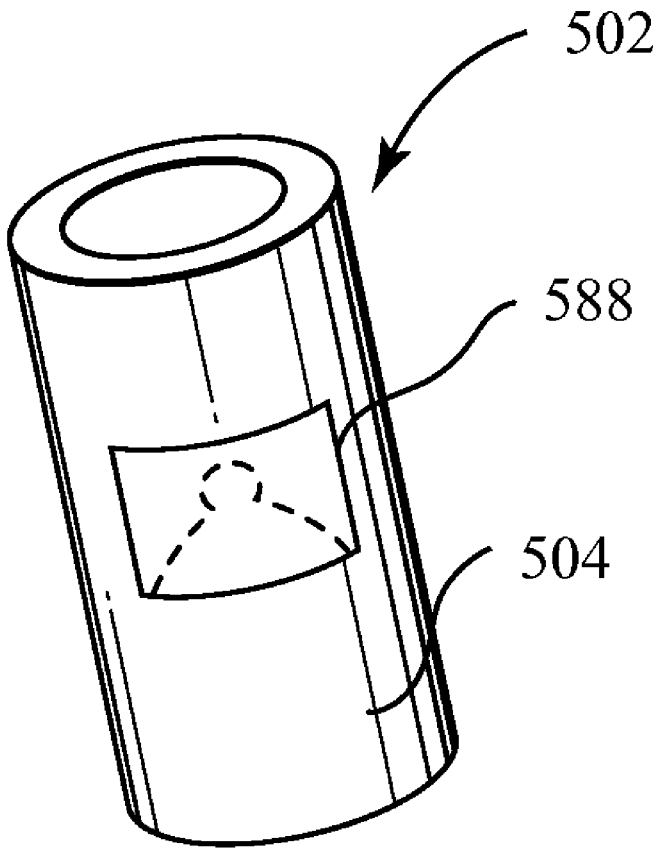
FIG. 6 is a perspective view of an embodiment of the invention where a display is indicated on the surface or in a recess of the candle.

In another embodiment of the invention shown in FIG. 6, a flameless candle 502 may have a display 588 positioned on the surface or in a recess of the candle body 504. Images produced on display 588 may be produced by any image or video generating means known in the art (not shown).

Figure 7:
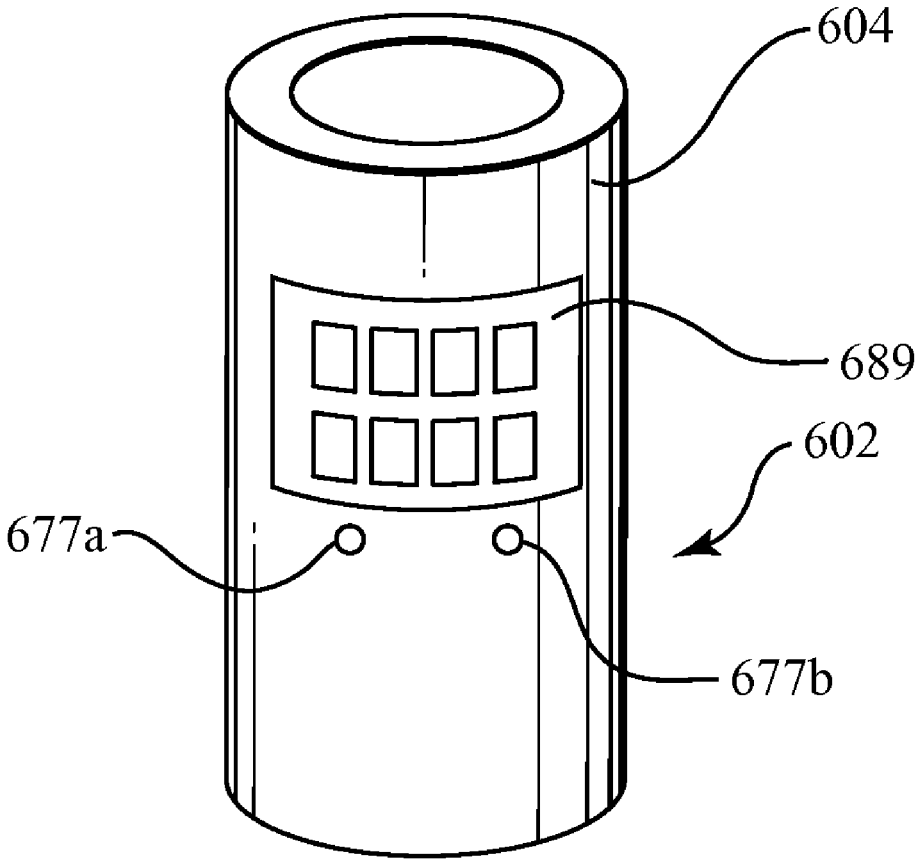
FIG. 7 is a perspective view of an embodiment of the invention where a clock display is indicated on the surface or in a recess of the candle.

In another embodiment of the invention shown in FIG. 7, a flameless candle 602 may have a clock display 689 positioned on the surface or in a recess of the candle body 604. The numbers generated on clock display 689 may be produced by any means known in the art (not shown). Also, there may be knobs or slides 677*a*, 677*b* for alarm and/or timer controls.

Figure 8:
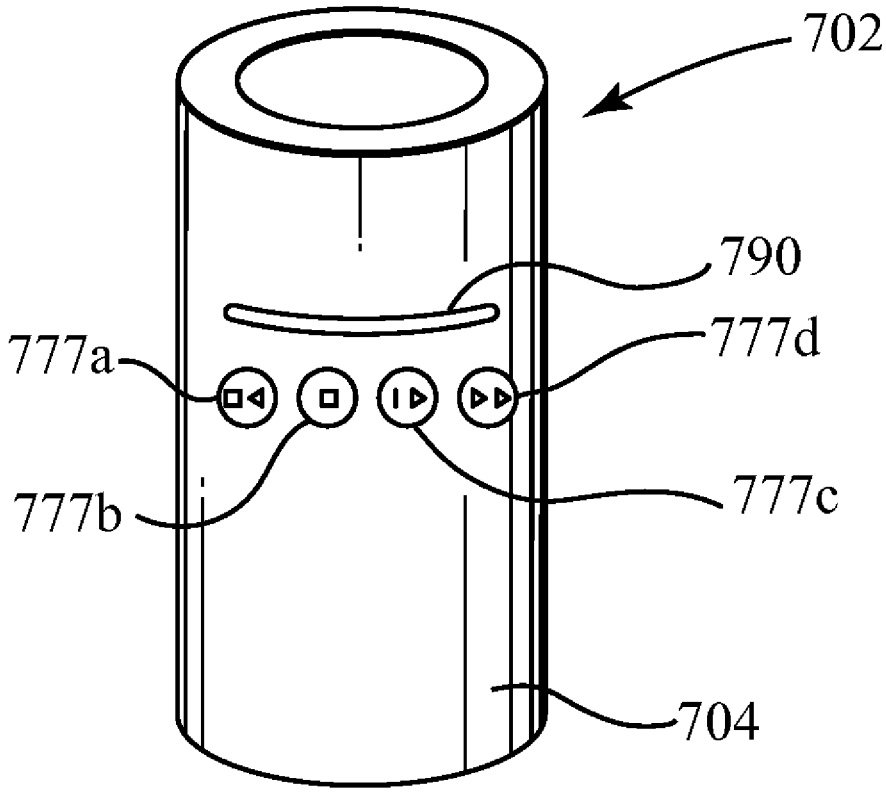
FIG. 8 is a perspective view of an embodiment of the invention where a compact disc loading slot is indicated on a candle.

In another embodiment of the invention shown in FIG. 8, a flameless candle 702 may have a compact disc loading slot 790. Compact discs (not shown) may be placed into slot 790 for audio playback. Compact discs may be played by means known in the art. Buttons 777*a*-777*d* may be located on candle body 704 for control of audio playback.

Figure 9:
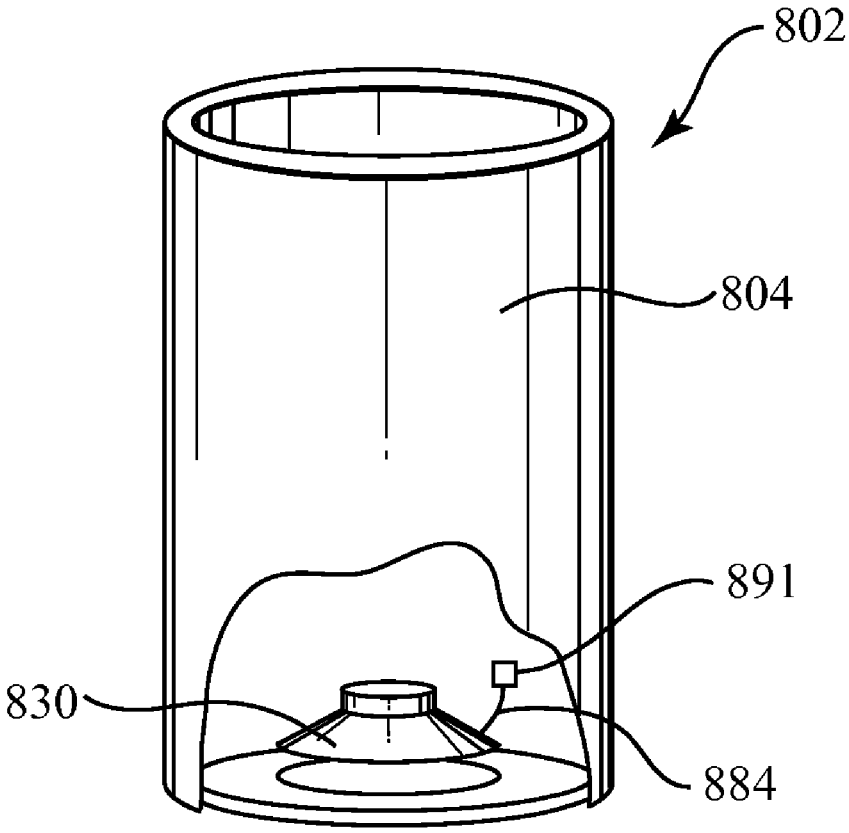
FIG. 9 is a view of another embodiment of the invention where a flameless candle is shown in partial cross-section indicating the position of a sound chip.

In an embodiment of the invention shown in FIG. 9, a sound chip 891 containing pre-recorded audio data is positioned within the body 804 of a flameless candle 802. Sound chip 891 is connected to a speaker 830 by a wire 884 to play pre-recorded audio data. There may be knobs or slides for audio playback control, volume or tone control, or balance (as shown in FIG. 3).

Figure 10:
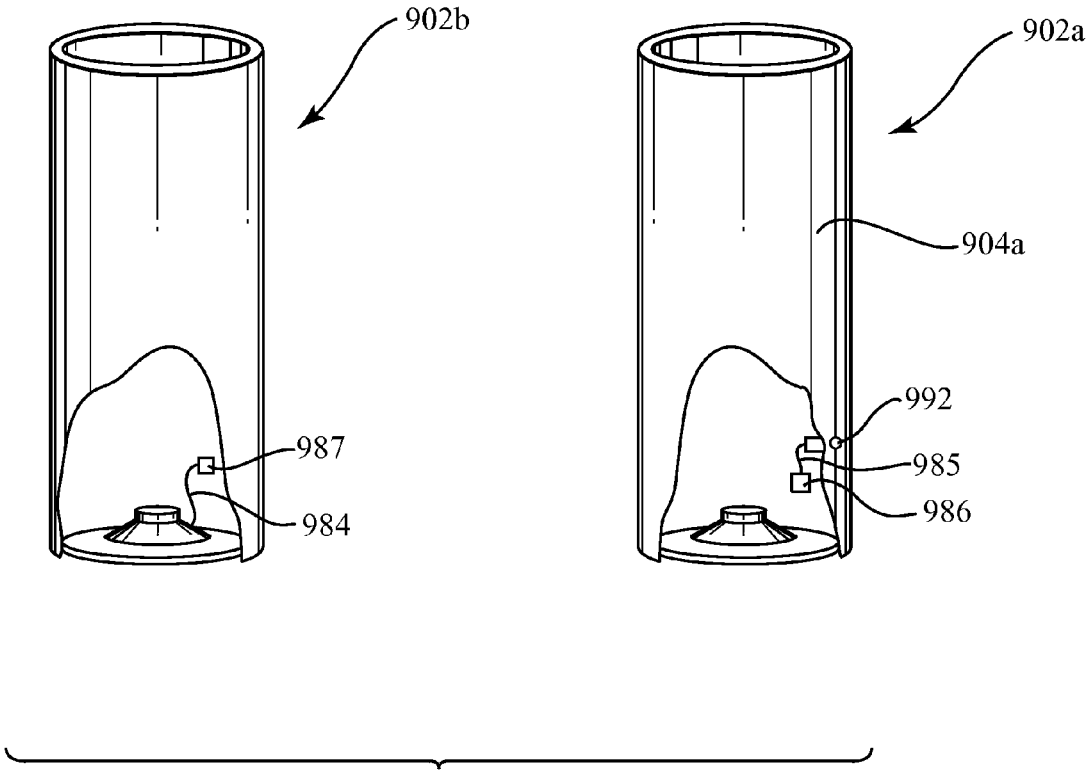
FIG. 10 is a view of an embodiment of the invention where one flameless candle is shown in partial cross-section indicating a microphone and wireless audio transmittal device and a second flameless candle is shown in partial cross-section indicating the wireless receiver device and the speaker.

In another embodiment of the invention shown in FIG. 10, a first flameless candle 902*a* functioning as a monitoring unit has a microphone 992 embedded in the body 904*a* of the candle 902*a*. Microphone 992 is connected to a wireless transmitter 986 by a wire 985 for broadcasting on a radio frequency ambient sounds picked up near the candle 902*a*. A second flameless candle 902*b* contains a wireless receiver 987 which is tuned to the radio frequency signal from transmitter 986. Receiver 987 converts the ambient sounds from the radio frequency into an audio output signal. First flameless candle 902*a* may further contain a sensor (not shown) for detecting sound to activate microphone 992. There may be knobs or slides on candle 902*a* and/or candle 902*b* for audio playback control, volume or tone control, or balance (as shown in FIG. 3).

Figure 11:
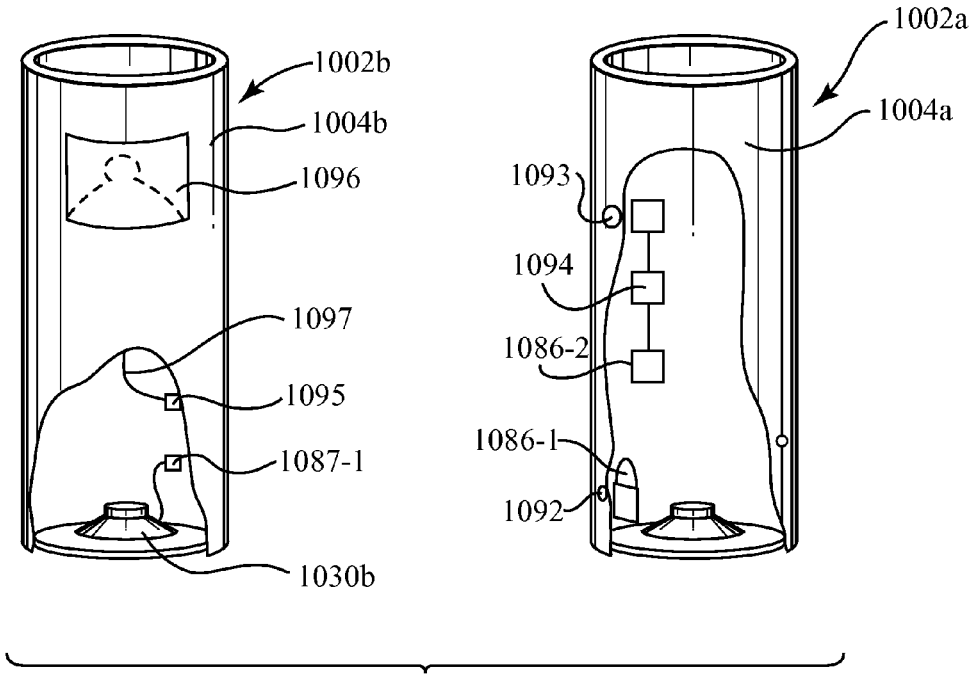
FIG. 11 is a view of an embodiment of the invention where one flameless candle is shown in partial cross-section indicating a camera, video compression device and wireless video transmittal device and a microphone and wireless audio transmittal device. The second flameless candle is shown in partial cross section indicating a wireless video receiver and decompression device connected to the display on the exterior of the candle and a wireless audio receiver device connected to the speaker.

In another embodiment of the invention shown in FIG. 11, a first flameless candle 1002*a* has a microphone 1092 embedded in the body 1004*a* of the candle 1002*a*. The microphone 1092 is connected to a wireless transmitter 1086-1 for broadcasting on a radio frequency ambient sounds picked up near the monitoring unit. First flameless candle 1002*a* also has a camera 1093 embedded in the body 1004*a* of the candle 1002*a*. Camera 1093 is coupled to video compression circuitry 1094, which receives video signals from camera 1093 and compresses the signals. A wireless transmitter 1086-2 is coupled to the video compression circuitry 1094 for transmission of the compressed video signals from camera 1093. A second flameless candle 1002*b* contains a wireless receiver 1087-1 tuned to the radio frequency signal from the wireless transmitter 1086-1 and means within receiver 1087-1 for detecting and converting ambient sounds in the radio frequency into an audio output signal for speaker 1030*b*. Second flameless candle 1002*b* further contains a video receiver and video decompression circuitry 1095 for decompressing transmitted images from first flameless candle 1002*a*. The video decompression circuitry 1095 is coupled via wire 1097 to a display 1096 positioned on the candle body 1004*b* or in a recess of the candle body 1004*b* for selectively displaying decompressed video signals. First flameless candle 1002*a* may further contain a sensor (such as sensor 18 of FIG. 1) for detecting sound or movement to activate the microphone 1092 and camera 1093. There may be knobs or slides for video and audio playback control, volume or tone control, or balance (as shown in FIG. 3 with additional video controls).

Figure 12:
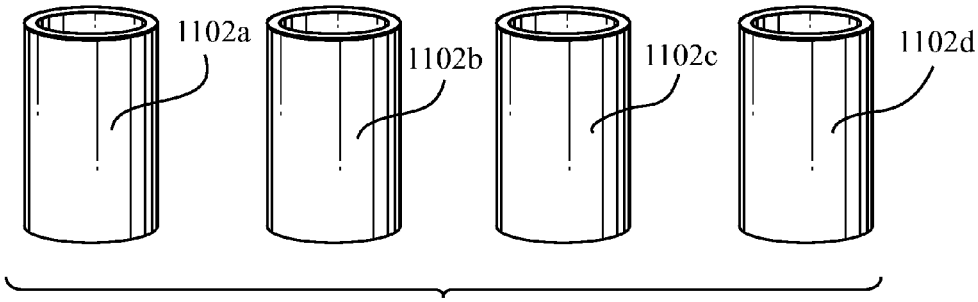
FIG. 12 is a view of another embodiment of the invention where four candles are used to provide surround sound.

Turning to FIG. 12, four flameless candles 1102*a*, 1102*b*, 1102*c*, and 1102*d* are shown (although more can be used). The four flameless candles may be connected together by wires (not shown) or may be wirelessly connected. In any event, it is preferred that one of the candles, e.g., candle 1102*a*, be a "master" candle with sound controls, and that the other candles, e.g., candles 1102*b*-1102*d*, be "slave" candles which are controlled by the master candle. In this manner (and typically using a sub-woofer as well), "surround sound" may be generated as known in the audio arts.

Figure 13:
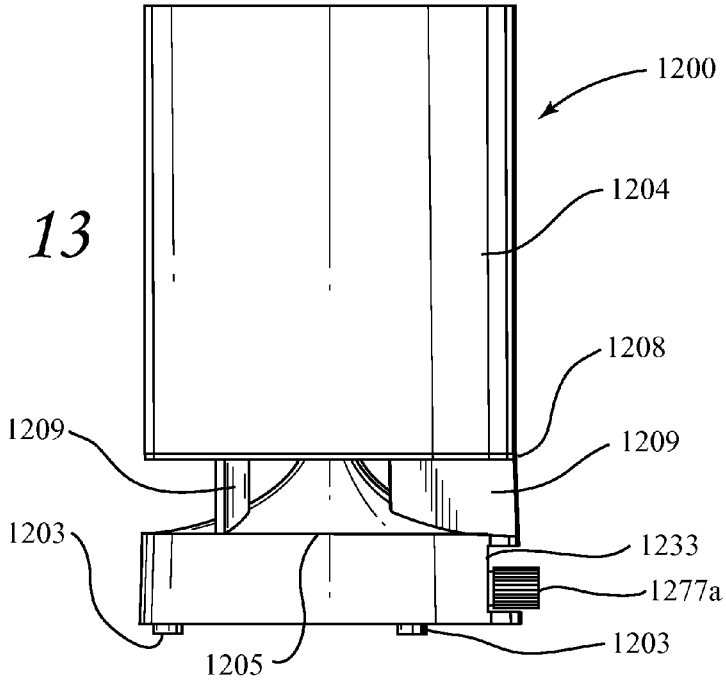
FIG. 13 is a view of another embodiment of the invention where the cylindrical body is supported by a lateral member disposed on top of a base structure, and the LEDs are mounted in a lighting module housing and operated in a variety of lighting modes.
Figure 14:
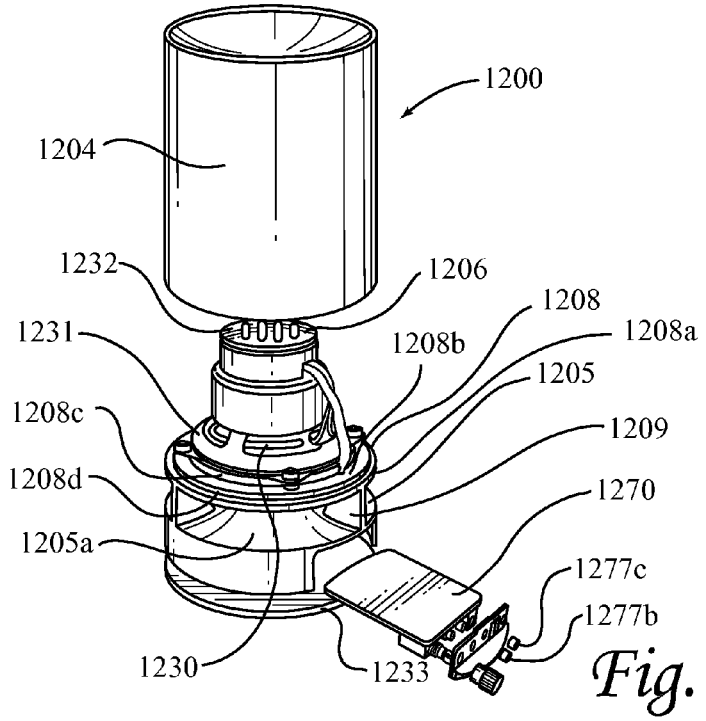
FIG. 14 is an exploded view of the embodiment of the invention shown in FIG. 13 rotated in a different orientation.
Figure 15:
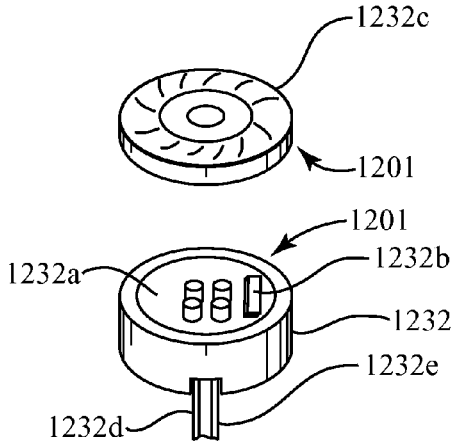
FIG. 15 is an enlarged view of the lighting module of FIG. 14.

In another embodiment of the invention shown in FIGS. 13-15, a flameless candle 1200 has a base 1205, a lateral member 1208 mounted to the top of the base 1205, a translucent cylindrical body 1204 and a speaker 1230. As hereinafter described, the cylindrical body 1204 and the speaker 1230 are disposed on top of and supported by the lateral member 1208. A lighting module 1201 housing a plurality of bulbs or LEDs 1206 is mounted on top of the speaker 1230 inside the cylindrical body 1204.

The base 1205 has the shape of a flattened cylinder with an upwardly projecting conical top surface 1205*a* that rises to a centered tip (not shown). A plurality of feet 1203 project downward from the bottom of the base 1205 to support the candle 1200. A plurality of supports 1209 project upward from the conical top surface 1205*a* of the base 1205 to support the lateral member 1208. The base 1205 defines a front recess 1233 for receiving a control housing 1270 that houses circuitry (as discussed below with reference to FIGS. 16-17) to which various knobs, jacks, and push buttons 1277*a*, 1277*b*, 1277*c* are coupled. As shown, knob 1277*a* is an on/off switch and volume control. The push button 1277*c* preferably switches the candle 1200 to a variety of lighting modes involving the operation of the plurality of bulbs or LEDs 1206 as further discussed below.

The lateral member 1208 is mounted to the top of the plurality of supports 1209 projecting upward from the base 1205 by set screws passing through holes (not shown) in the lateral member 1208 or by other equivalent mounting means known in the art. The lateral member 1208 preferably has a ring shaped, substantially planar bottom surface 1208*a* and a mounting structure 1208*b* mounted on top of the bottom surface 1208*a* of the lateral member 1208. The lateral member 1208 also defines a centered hole 1208*c* for receiving the front side of a speaker assembly 1230. The centered hole 1208*c* passes through the planar bottom surface 1208*a* and mounting structure 1208*b*, and is approximately two and a half inches in diameter. The mounting structure 1208*b* includes an outer rib 1208*d* extending upward orthogonal to the planar bottom surface 1208*a* of the lateral member 1208 and offset from the outer edge of the bottom surface 1208*a* of the mounting structure 1208*b* by a distance approximately equal to the wall thickness of the cylindrical body 1204. The outer rib 1208*d* preferably has a small flange (not shown) extending outward from the outer rib 1208*d* parallel to the bottom surface 1208*a* for snap fitting the bottom of the cylindrical body 1204 onto the lateral member 1208. The bottom of the cylindrical body 1204 preferably defines one or more recesses (not shown) for receiving the small flange. The cylindrical body 1204 is thus placed on top of the lateral member 1208 and pushed downward until it snaps into the assembled configuration shown in FIG. 13.

The speaker 1230 includes a housing 1231 which is mounted on top of the mounting structure 1208*b* of the lateral member 1208 by set screws or any other mounting means known in the art. The speaker housing 1231 houses the rear portion of the speaker assembly 1230. A lighting module 1201 including a circuit board 1232*a* with a chip 1232*b*, LEDs 1206, a diffuser cover 1232*c*, and a casing 1232 is mounted to the top of the speaker housing 1231 for securing and protecting the bulbs or LEDs 1206, which are operably disposed inside of the casing 1232. The translucent diffuser cover 1232*c* of the casing 1232 transmits but obscures light emanating from the LEDs 1206 through the cover 1232*c*. Light from the LEDs 1206 thus passes through the translucent cover 1232*c* of the casing 1232, through the interior space defined by the cylindrical body 1204, and through the translucent walls of the cylindrical body 1204. Wires 1232*d*, which extend out of the casing 1232 and down through the lateral member 1208 and support 1209 preferably connect the circuit board 1232*a* and/or LEDs 1206 to a power source, additional circuitry, and/or a switch located in the base 1205. Wires 1232*e* also connect the circuit board 1232*a* to the speaker 1230.

In the preferred embodiment, the bulbs or LEDs 1206 are electronically coupled to the push button 1277*c* such that the push button 1277*c* may be iteratively depressed by a user to achieve a variety of single color lighting modes and a final lighting mode. The LEDs 1206 may comprise white, blue, red, green, and/or a variety of other colors. When the push button 1277*c* is depressed once, one of the variety of colors is activated, such as, for example, red. When the push button 1277*c* is depressed a second time, the red bulb or LED is deactivated and another of the variety of colors, such as blue, is activated. The push button 1277*c* may be iteratively depressed in this fashion to toggle between different colored lights. Preferably, a final lighting mode is achieved after a user depresses the push button 1277*c* enough times to pass through the lighting modes for each of the LED colors situated within the casing 1232. The final lighting mode is a design mode that has several steps. First, a first of the LEDs is activated at a low intensity. Second, the intensity of the first activated LED is slowly raised until the first activated LED (corresponding to a specific color) reaches a predetermined threshold brightness. Third, a second of the LEDs is activated at a low intensity while the first activated LED is decreased in intensity until the second of the activated LEDs reaches the threshold brightness and the first of the activated LEDs is turned off completely. Fourth, a third of the LEDs is activated at a low intensity while the second of the activated LEDs is decreased intensity. This process continues through all of the LEDs and repeats, starting again with the first activated LED, unless a user depresses the push button 1277*c*, at which point the flameless candle achieves one of the single color modes as discussed above.

A functional block diagram 1300 for these lighting modes used in conjunction with the speakers and stereo in the various embodiments discussed above is schematically shown in FIG. 16. A power source 1338 supplies power to a power control device 1339, which in turn supplies power to an array control and driver 1326 and to speaker driver circuitry 1330B. The LED array control and driver 1326 is preferably regulated by an LED control input 1328 (which can be one of the control push buttons discussed above), and drives the LEDs 1306 according to lighting mode selected by the user. The speaker driver circuitry 1330B drives the speakers 1330.

Figure 17:
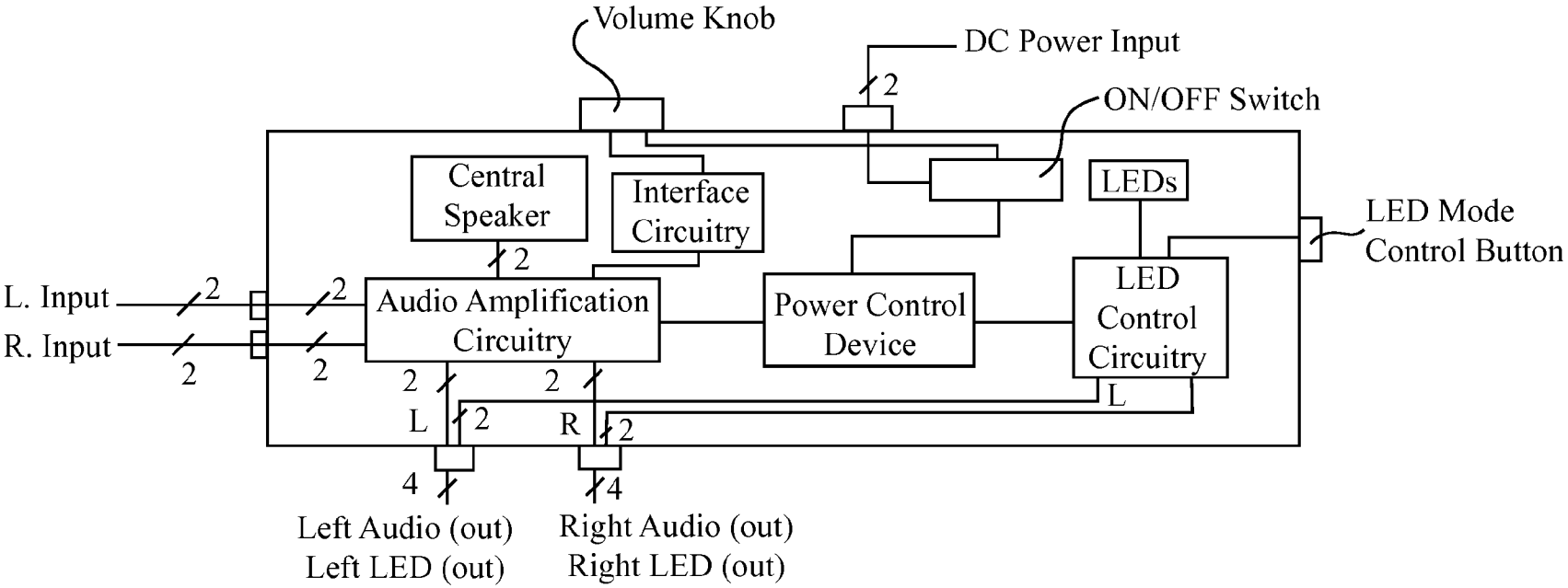
FIG. 17 is a schematic of the circuitry of another embodiment of the invention in which a master candle is equipped with audio amplification circuitry, LED control circuitry, an input control switch and knob, a terminal for connecting to the port of a portable audio device, and wiring which electronically couples the master candle to at least one slave candle.

A schematic of the circuitry for one preferred embodiment is shown in FIG. 17. The circuitry of FIG. 17 is preferably housed within a control housing of the master candle such as that described with respect to FIGS. 13-15. As shown in FIG. 17, a volume knob is electronically coupled to an on/off switch, which, when 'on,' allows a DC power input supply to reach a power control device. The power control device supplies appropriate power to audio amplification circuitry and to LED control circuitry. The amplification circuitry drives the central speaker of the master candle and also outputs left and right audio signals, which are received by at least one slave candle (such as the one described with reference to FIG. 12). The LED control circuitry drives the LEDs in the master candle, and outputs left and right LED signals, which are received by the at least one slave candle. The LED mode control button is electronically coupled to the LED control circuitry. Thus, both the speaker volume and LED function in the master and slave candles are controlled by the volume knob and LED mode control button of the master candle.

Figure 18:
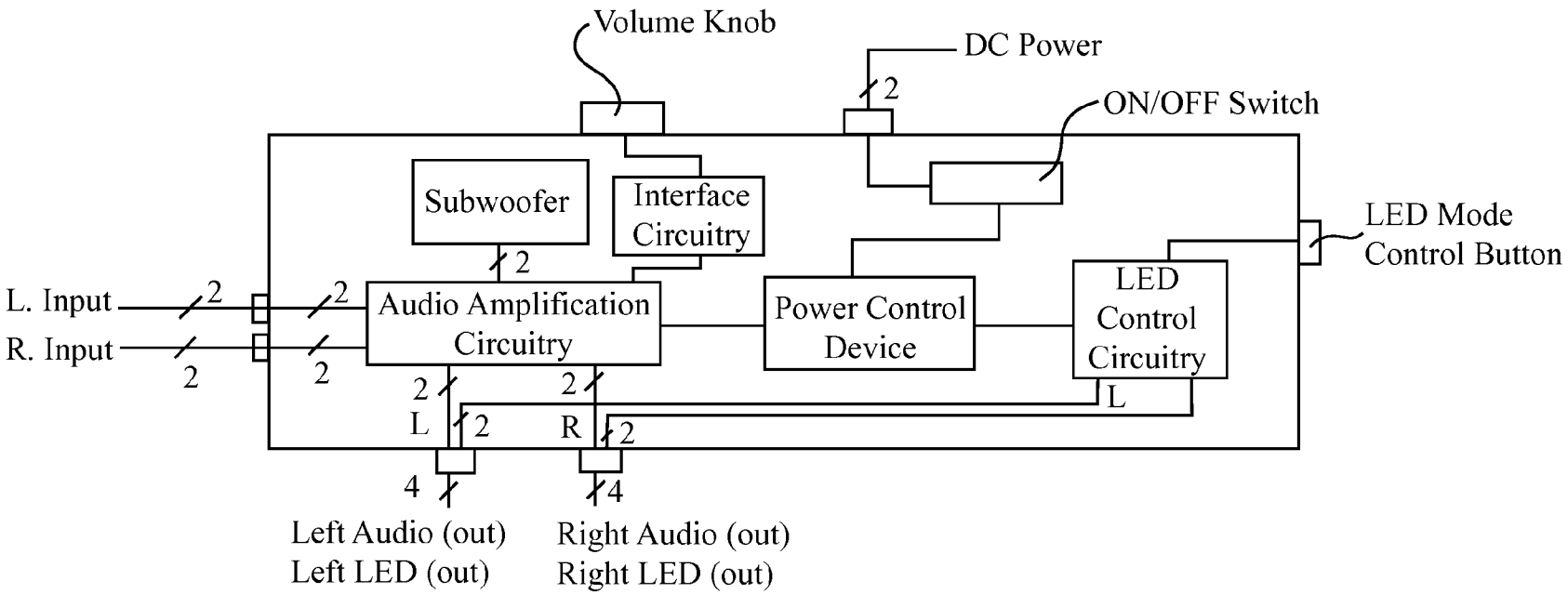
FIG. 18 is a schematic of the circuitry of another embodiment of the invention in which a controller houses a subwoofer, audio amplification circuitry, LED control circuitry, an input control switch and knob, and a terminal for connecting to the port of a portable audio device.
Figure 19A:
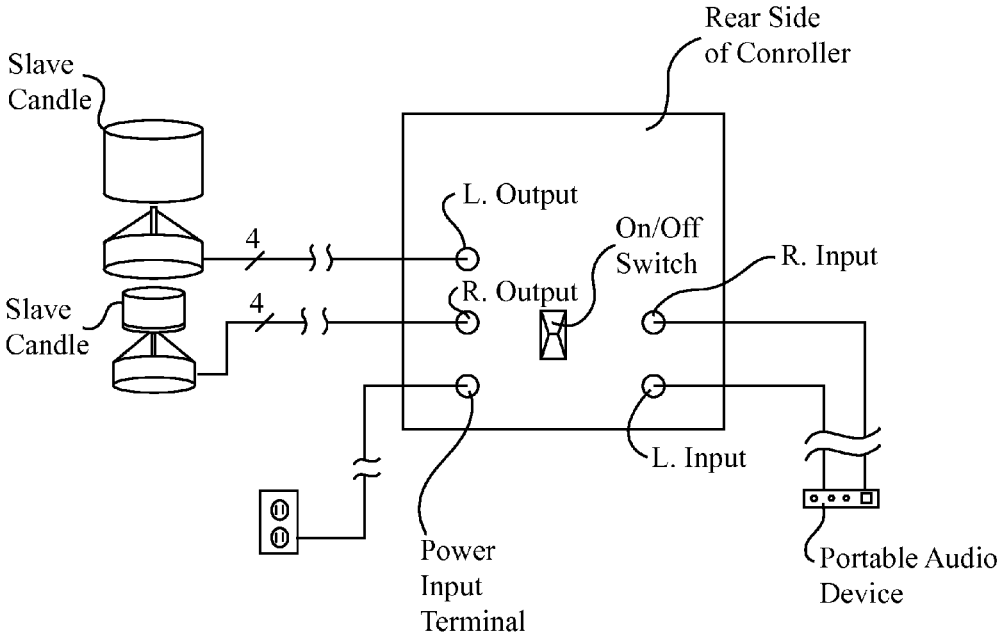
FIG. 19A is a rear view of the controller of FIG. 18 and a schematic of the connections between the controller and the slave candles, wall outlet, and portable audio device.
Figure 19B:
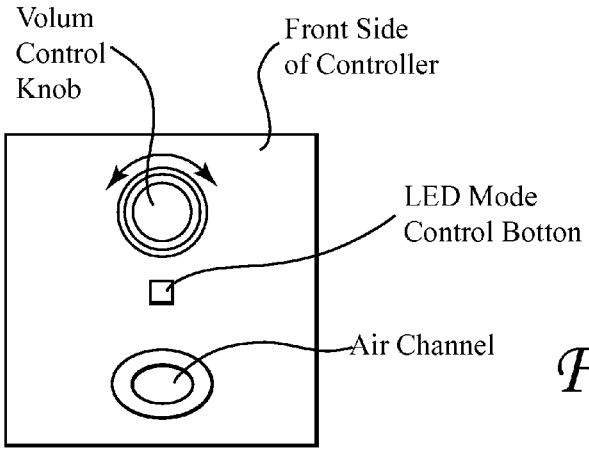
FIG. 19B is a front view of the controller of FIG. 19A.

A schematic of the circuitry for another preferred embodiment is shown in FIG. 18. Here, the circuitry is virtually identical to that described with respect to FIG. 17 except that a subwoofer unit is utilized as a master, and the volume knob is electronically coupled to both the on/off switch and the audio amplification circuitry. The volume knob is thus used both to turn the device on and off, as well as to control the volume of sound coming from the subwoofer and the slave candles in electrical communication with the controller. In this embodiment, the subwoofer, audio amplification circuitry, LED control circuitry, interface circuitry, volume knob, and LED mode control button are housed in the controller, which takes the place of the "master candle" described in previous embodiments. The controller electronically couples to the port of a portable audio device and outputs audio data from the portable audio device through at least one slave candle. The controller also drives the LEDs in the slave candles via the LED control circuitry based on the LED mode selected by a user with the LED control button. Front and rear views of the controller for this embodiment are shown in FIGS. 19A and 19B respectively. The rear side of the controller has a left output, a right output, a power input terminal, on/off switch, left input, and right input. The left and right inputs connect to a portable audio device. The left and right outputs connect to slave candles. The front side of the controller has a volume control knob, an LED mode control button, and an air channel for allowing airflow into and out of the controller to enable operation of the subwoofer (not shown).

Figure 16:
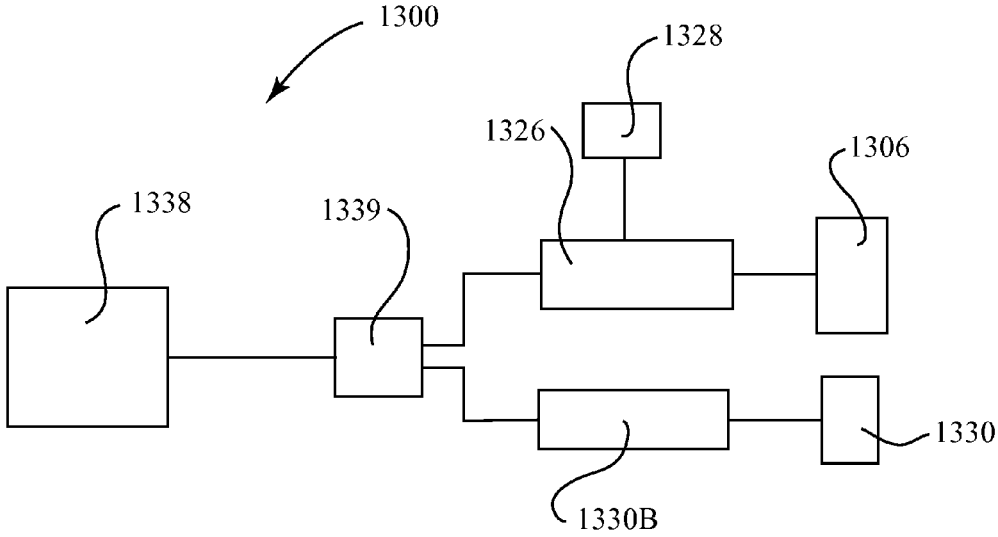
FIG. 16 is a functional block diagram of the circuitry of the invention shown in FIGS. 13-15.

The flameless candle shown in FIGS. 13-15, as well as the circuitry disclosed in FIGS. 16-18 and the controller of FIGS. 19A-19B, may be incorporated into, or used in conjunction with, all of the embodiments illustrated and discussed with respect to the other Figures. For example, in the embodiment shown and described in FIG. 12, the master candle may be equipped with a push button for a user to activate the various lighting modes discussed above, and thereby achieve the various lighting modes in the master candle and the slave candles.

It is within the scope of the invention that the arrangements described above can be modified extensively, dependent upon the size of the candle body, the size of the lights used, the number, location, and type of batteries used, the size and type of speakers, and the like.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A flameless candle for use by a user, comprising:

a translucent hollow body which is adapted to not burn, said body including a translucent generally cylindrical sidewall and a translucent concave top surface integrally formed with said sidewall, said top surface defining a first opening;

a decorative wick adapted to not burn extending through said first opening and external to said body;

a non-flammable source of light positioned within the body;

a sound-generating means positioned within the body;

a base which includes a cylindrical portion, a top conical surface extending upward from said cyclindrical portion toward said sound-generating means, a plurality of support members extending upward from said top conical surface, a lateral member disposed above said top conical surface and supported by said plurality of support members, said lateral member supporting the translucent hollow body and the sound-generating means and defining a second opening for receiving at least a portion of said sound-generating means, said lateral member, said support members, and said top conical surface together defining side openings in said base for outwardly guiding sound emanating from said sound-generating means; and a user manipulatable multiple position electric switch operably disposed on said base, said switch coupled to said source of light and to said sound-generating means for operation thereof, wherein said translucent hollow body, said decorative wick, and said non-flammable source of light together provide said flameless candle with the appearance of a real candle.

2. The candle of claim 1, wherein:
the source of light is a plurality of bulbs or LEDs.

3. The candle of claim 2, wherein:
said candle includes LED control circuitry for achieving a plurality of single color lighting modes.

4. The candle of claim 3, wherein:
said LED control circuitry achieves a switching lighting mode where the plurality of LEDs switch through a range of different colors.

5. The candle of claim 4, wherein:
said switching lighting mode includes a first step wherein a first of said plurality of LEDs is activated at a low intensity, and a second step wherein the intensity of light produced by said first LED is slowly raised until a predetermined threshold brightness is reached.

6. The candle of claim 5, wherein:
said switching lighting mode further includes a third step wherein, once said first LED reaches said predetermined threshold brightness, a second of said plurality of LEDs is activated at a low intensity and slowly increased while the brightness of said first LED is decreased until said second LED reaches the threshold brightness, at which time said first LED is turned off by said LED control circuitry.

7. The candle of claim 6, wherein:
said switching lighting mode further includes a fourth step wherein, once said second LED reaches the threshold brightness and said first LED is turned off, a third of said plurality of LEDs is activated at a low intensity and slowly increased while the brightness of said second LED is decreased until said third LED reaches the threshold brightness, at which time said second LED is turned off.

8. The candle of claim 7, wherein:
said switch is a push button switch adapted to be iteratively depressed by a user to achieve said plurality of single color lighting modes and said final lighting mode.

9. The candle of claim 1, further comprising:
a photo sensor mounted to said candle for detecting the level of light in the environment surrounding the candle and controlling the light intensity of said source of light in response to a level of light in the environment surrounding said candle.

10. The candle of claim 1, wherein:
said sound generation means is a speaker.

11. A flameless candle according to claim 1, wherein:
said top conical surface rises to a centered tip.

12. A flameless candle according to claim 1, wherein:
the lateral member is ring shaped.

13. The candle of claim 1, further comprising:
an audio interface for connecting to a portable audio device.

14. The candle of claim 13, wherein:
said audio interface is an external modular docking unit.

15. The candle of claim 1, further comprising:
a sound chip positioned within said hollow body, said sound chip programmed to play pre-recorded audio data.

16. The candle of claim 1, further comprising:
an AM/FM receiver positioned within said hollow body.

17. The candle of claim 1, further comprising:
a video display positioned within or on said hollow body.

18. The candle of claim 17, wherein:
said sidewall has a recess, and said video display is located in said recess on said sidewall of said hollow body.

19. The candle of claim 1, wherein:
said candle further comprises a clock positioned on said sidewall of said hollow body, wherein the clock includes a timer and an alarm.

20. The candle of claim 1, further comprising:
audio playback means.

21. The candle of claim 20, wherein:
said audio playback means is a compact disc player.

22. The candle of claim 1, wherein:
said sidewall has a recess, and said candle further comprises a camera positioned within said recess of said sidewall of said hollow body.

23. The candle of claim 1, further comprising:
a microphone positioned within said hollow body.

24. The candle of claim 1, wherein:
said sidewall has a recess and said candle further comprises a motion detection sensor positioned within said recess of said sidewall of said hollow body, said motion detector sensor being connected to said non-flammable source of light.

25. The candle of claim 24, wherein:
said non-flammable source of light is activated by a signal from said motion detection sensor.

* * * * *